US005120216A

United States Patent [19]

Iwahori

[11] Patent Number: 5,120,216

[45] Date of Patent: Jun. 9, 1992

[54] OPERATION MEMBER FOR LIGHTER

[75] Inventor: Fukuo Iwahori, Shizuoka, Japan

[73] Assignee: Iwax, Inc., Shizuoka, Japan

[21] Appl. No.: 689,292

[22] Filed: Apr. 22, 1991

[51] Int. Cl.[5] ..... F23Q 1/04

[52] U.S. Cl. ..... 431/254; 431/150; 431/130; 431/274

[58] Field of Search ..... 431/254, 274, 150, 130, 431/131

[56] References Cited

U.S. PATENT DOCUMENTS

| | | | |
|---|---|---|---|
| 4,099,907 | 7/1978 | Fuller | 431/254 |
| 4,146,358 | 3/1979 | Dixon | 431/254 |
| 4,758,152 | 7/1988 | Kordecki | 431/153 |
| 4,784,601 | 11/1988 | Nitta | 431/153 |
| 4,799,877 | 1/1989 | Bisbee | 431/153 |
| 4,830,603 | 5/1989 | Cirami | 431/153 |
| 4,832,596 | 5/1989 | Morris, Sr. | 431/153 |

*Primary Examiner*—Carroll B. Dority
*Attorney, Agent, or Firm*—Harrison & Egbert

[57] ABSTRACT

A lighter for lighting tobaccos such as cigarettes and cigars. A striker wheel is not exposed on the outside of the lighter body and an operation member for rotating the striker wheel is provided over the striker wheel, said operation member being connected with a gas lever for controlling the emission of gas, said striker wheel being rotated only when the operation member is pushed down with a relatively large force and turned. Therefore, the present invention minimizes the possibilities that infants make a fire by means of the lighter or unexpected accidental ignition is caused by the lighter in storage, etc.

4 Claims, 5 Drawing Sheets

OPERATION MEMBER FOR LIGHTER

BACKGROUND OF THE INVENTION

1. Field of the Invention

The present invention relates to a lighter for lighting tobaccos such as cigarettes and cigars.

2. Description of the Prior Art

A conventional lighter which makes a fire by friction between a flint and a striker wheel comprises, as shown in FIG. 5, a fuel well 21 containing fuel, a gas nozzle 22 through which gas from said fuel well 21 is emitted, a flint 23 disposed near said gas nozzle 22, a striker wheel 24 rotatably disposed in sliding contact with said flint 23, said flint 23 being pressed against said striker wheel 24 by a spring 26, a gas lever 25 adapted to pull up said gas nozzle 22 so as to allow the emission of gas almost simultaneously with the rotation of said striker wheel 24, said nozzle 22 being adapted to be pulled down to its original position by a spring 27 when said gas lever 25 is released. This conventional lighter makes a fire as follows: If the striker wheel 24 is rotated by the thumb for example, sparks are emitted by friction between the striker wheel 24 and the flint 23 which is pressed against the striker wheel 24 by the spring 26. Almost simultaneously therewith, the thumb which has finished rotating the striker wheel 24 contacts and pushes down the gas level 25, which pulls up said gas nozzle 22 by leverage so as to emit gas. Now, the sparks emitted by the striker wheel 24 and the flint 23 set fire to the gas. When the thumb leaves the gas level 25, the gas nozzle 22 is pulled down to its original position by the spring 27 to stop the emission of gas and put out the fire.

The conventional lighter described above is designed to make a fire simply by rotating the striker wheel or auxiliary wheels provided on two opposite sides of the striker wheel, said striker wheel and auxiliary wheels being exposed on the outside of the lighter body. Therefore, even an infant can easily make a fire by means of such a lighter. Furthermore, if an infant holds the lighter upside down, presses the striker wheel against the floor, etc. and rotates the striker wheel thereon, then emitted sparks may light a floor carpet, etc. and cause misfortunes such as a burn and a fire.

Also, flint powder on the striker wheel may stick to the thumb because the striker wheel or the auxiliary wheels is rotated directly by the thumb. The exposed striker wheel may stain clothing when the lighter is put into a pocket, etc. of clothing.

Since a flame forming portion including the gas nozzle is exposed, a tiny fire may remain unextinguished on the gas nozzle after the use of the lighter and cause misfortunes such as a burn and a fire.

BRIEF SUMMARY OF THE INVENTION

It is therefore a general object of the invention to provide a lighter which has obviated all the above-mentioned disadvantages of the conventional lighter.

It is a specific object of the invention to provide a lighter which does not easily make a fire even when an infant is playing therewith.

It is another specific oject of the invention to provide a lighter which does not stain the thumb or clothing with flint powder.

It is a further specific object of the invention to provide a lighter which extinguishes the fire completely after use to eliminate danger.

These and other objects have been attained by a lighter in which a striker wheel is not exposed on the outside of the lighter body and an operation member for rotating the striker wheel is provided over the striker wheel, said operation member being connected with gas lever for controlling the emission of gas, said striker wheel being rotated only when the operation member is pushed down with a relatively large force and turned.

More particularly, to achieve the above-mentioned objects, the present invention provides a lighter adapted to make a fire by sparks caused by friction between a flint and a striker wheel, said striker wheel being pressed against said flint by spring, the improvements comprising an operation member for rotating said striker wheel being provided over said striker wheel, said operation member being attached through a shaft or shafts to a lighter body, said operation member being movable to and from said striker wheel so as to engage with and disengage from said striker wheel, an elastic means being provided between said lighter body and said operation member, said elastic member always pushing said operation member in the direction of moving said operation member away from said striker wheel, said operation member being connected with a gas lever for controlling the emission of gas.

Said operation member may be mounted on the shaft or shafts of said striker wheel or a shaft or shafts separate therefrom. Said operation member may have a safety cover portion covering a flame forming portion including a gas nozzle.

The operation of the lighter according to the present invention will now be described.

The lighter of the present invention makes a fire when the operation member provided over the striker wheel is turned. However, if the operation member is turned only by a weak force, the operation member does not rotate the striker wheel because the operation member is kept away from the striker wheel by the elastic means. If the operation member is brought into contact with the striker wheel against the force of the elastic means and turned in this state, then the striker wheel is rotated by the operation member and rubbed against the flint. Now sparks are made by friction between the striker wheel and the flint. At the same time, the operation member moves the gas lever so as to allow the emission of gas. That is, the gas lever pulls up the gas nozzle so as to allow the emission of gas. The emitted gas is ignited by the sparks.

When the operation member is released from the force, the gas lever is set free and the emission of gas is stopped. That is, the gas nozzle is moved bact to its original position by the force of a spring and stops the emmission of gas. Thus, the fire is extinguished. The operation member is moved back to its original position by the force of the elastic means.

DETAILED DESCRIPTION

The present invention will now described in detail with reference to the attached drawings.

Figure 1:
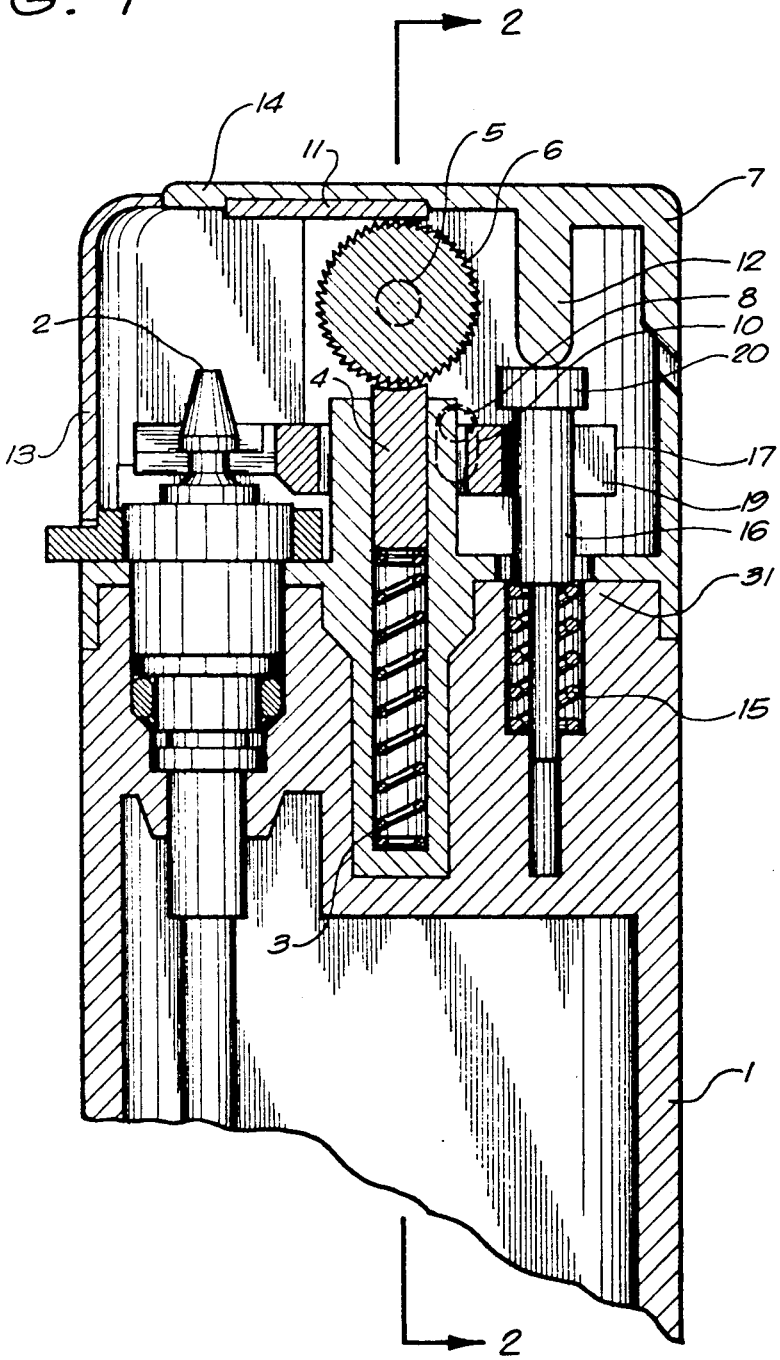
FIG. 1 is an enlarged sectional view of a lighter according to the present invention.
Figure 2:
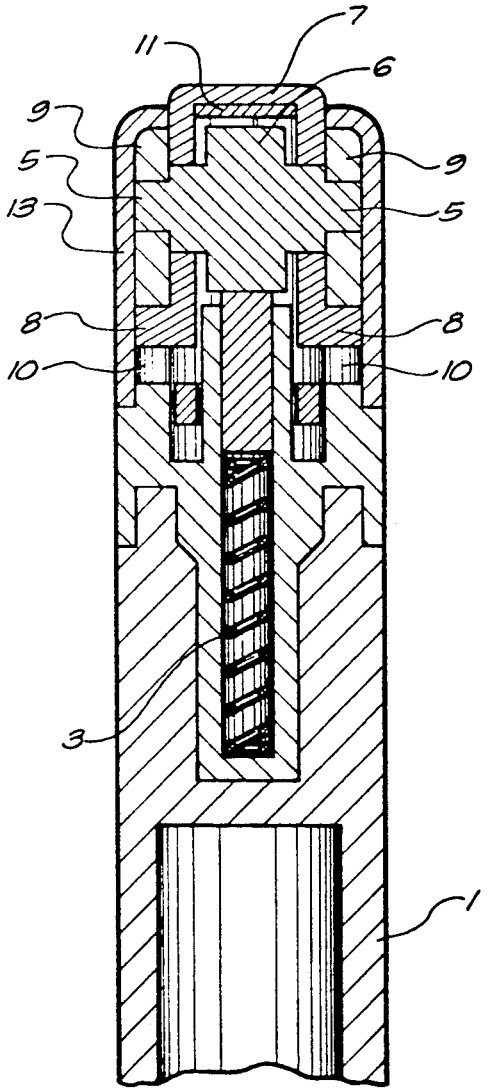
FIG. 2 is a sectional view taken on line II—II of FIG. 1.
Figure 3:
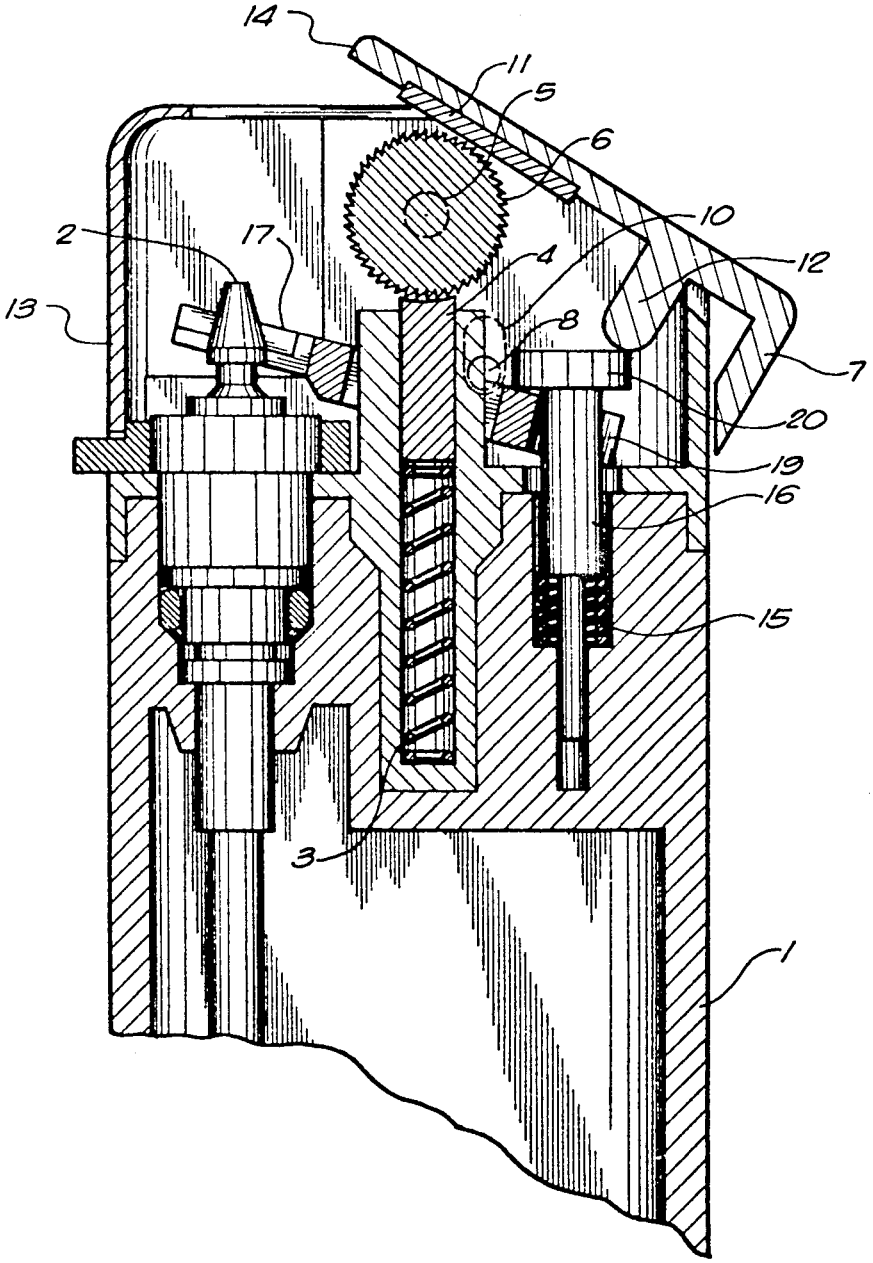
FIG. 3 is an enlarged sectional view of said lighter in use.
Figure 4:
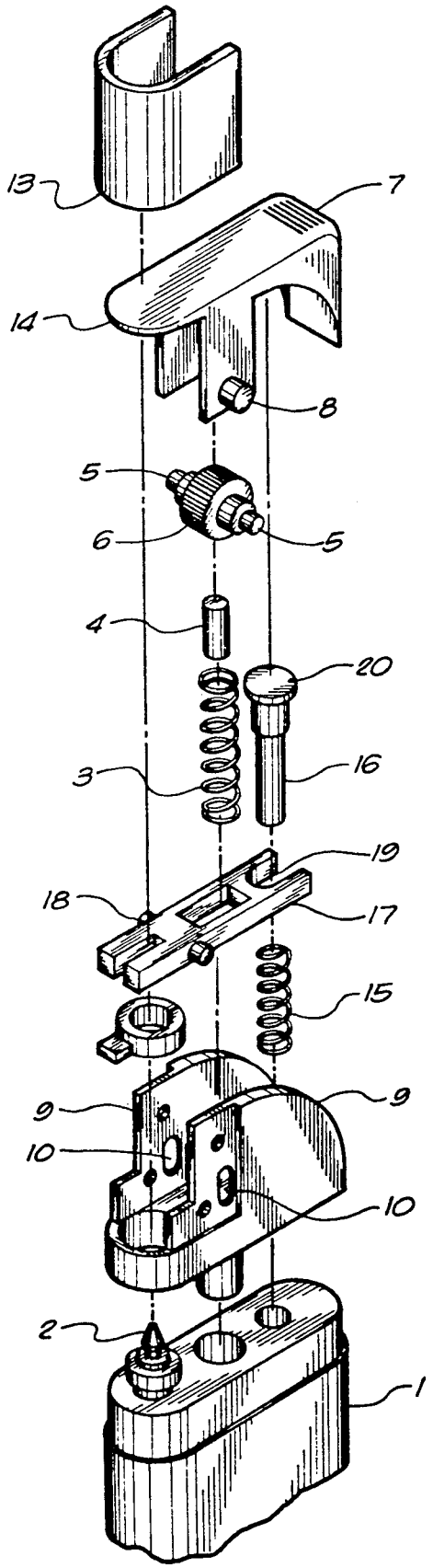
FIG. 4 is an exploded view showing parts of said lighter.
Figure 5:
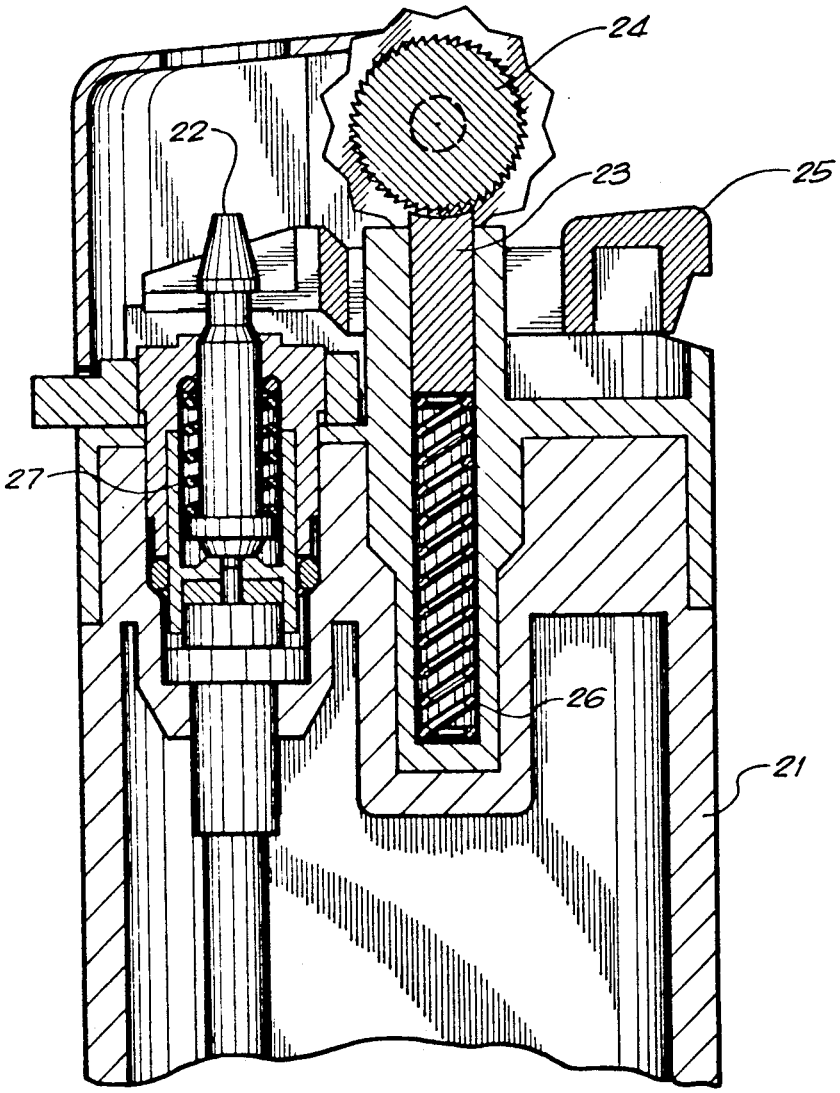
FIG. 5 is a sectional view of a conventional lighter.

FIGS. 1 to 4 shows a gas lighter according to the present invention. The lighter comprises a lighter body 1, a gas nozzle 2 provided on the lighter body 1, a flint 4 disposed near the gas nozzle 2, a striker wheel 6 rotatably attached through a pair of shafts 5, 5 to the lighter body 1, said flint 4 being always pushed upward against said striker wheel 6 by a spring 3 disposed within the lighter body 1, and an operation member 7 for rotating said striker wheel 6, said operation member 7 being disposed over the striker wheel 6. The operation member 7 is movable to and from said striker wheel 6 so as to engage with and disengage from said striker wheel 6. That is, operation member 7 is provided on two opposite sides thereof with shafts 8, 8, and these shafts 8, 8 are inserted into holes 10, 10, longer in the vertical direction, provided on side plates 9, 9 of the lighter body 1, so that the operation member 7 is movable in the vertical direction. Alternatively, the operation member 7 may be supported on said shafts 5, 5 of the striker wheel 6. The operation member 7 is provided inside with a friction portion 11 which is adapted to engage with the striker wheel 6 to rotate the striker wheel 6. The friction portion 11 may have a rough surface engageable with the rough surface of the striker wheel 6, or may be provided with an elastic material. The operation member 7 has a pushing portion 12 which is a downward projection for pushing down a gas lever described later. Furthermore, the operation member 7 is integrally provided with an arc-shaped safety cover portion 14 which is adapted to fit an arc-shaped protection 13 from wind on top of the lighter body 1 so as to cover the top opening and flame forming portion of the lighter body 1.

An elastic means 31 is provided between said pushing portion 12 and the lighter body 1. The elastic means 31 comprises a spring 15 disposed within the lighter body 1, and a pushing rod 16 pushed up by the spring 15 against the lower end of the pushing portion 12. The spring 15 may be a coiled spring, leaf spring or any other spring. When the operation member 7 is not pushed down, the operation member 7 is kept in a high position by the elastic means 31 and the friction portion 11 thereof is not in contact with the striker wheel 6. In this state, even if an infant should turn the operation member 7 with a force which is not large enough to compress the elastic means 31, the friction portion 11 of the operation member 7 does not contact or rotate the striker wheel 6. Therefore, the lighter does not make a fire.

The operation member 7 covers the striker wheel 6, flint 4 and gas lever so that these are not exposed on the outside of the lighter.

Said gas nozzle 2 is moved up and down by a gas lever 17, the middle portion of which is attached through a pair of shafts 18, 18 to the lighter body 1. The gas lever 17 is provided on one end thereof with a fork portion which is engaged with the head of the gas nozzle 2, and on another end thereof with an opening 19 into which said pushing rod 16 of the elastic means 31 is inserted. At the same time that the striker wheel 6 in contact with the flint 4 is rotated by means of the operation member 7 so as to emit sparks, the pushing portion 12 of the operation member 7 pushes down the pushing rod 16 of the elastic means 31, the large head 20 of the pushing rod 16 pushes down said another end of the gas lever 17, and said one end of the gas lever 17 pushes up the gas nozzle 2 so as to open a gas valve (not shown) in a gas chamber and allow the emission of gas. Now the emitted gas is ignited by the sparks.

Thus, according to the present invention, the striker wheel is not exposed on the outside of the lighter body and the operation member for rotating the striker wheel is provided over the striker wheel, said operation member being connected with the gas lever, said striker wheel being rotated only when the operation member is pushed down with a relatively large force and turned. Therefore, the present invention minimizes the possibilities that infants make a fire by means of the lighter or unexpected accidental ignition is caused by the lighter in storage, etc. Since it is possible to make a fire only by pushing and turning the operation member and without touching the striker wheel or the gas lever, the thumb is free from being stained with flint powder or feeling a pain by the rough surface of the striker wheel.

If the operation member is integrally provided with a safety cover portion covering the flame forming portion including the gas nozzle, the fire made by the lighter is completely extinguished after use and the possibilities of misfortunes by a remaining fire is eliminated. Furthermore, the operation member covering the top of the lighter improves the appearance thereof.

What is claimed is:

1. An improved lighter adapted to make a fire by sparks caused by friction between a flint and a striker wheel, the lighter having a striker wheel rotatably mounted to a lighter body, the flint in spring-supported pressurized contact with the striker wheel, the improvement comprising:

an operation member positioned adjacent a surface of said striker wheel at a top of the lighter body, said operation member connected by a shaft to the lighter body, said shaft mounted in vertically elongated holes in the lighter body, said shaft extending across the lighter body, said operation member interactive with a gas lever for controlling the emission of a gas from the lighter body, said operation member movable vertically relative to the lighter body between a first position distal said striker wheel and a second position engaging a surface of said striker wheel, said operation member rotatable about said shaft between said second position and a third position, said operation member actuating said gas lever in said third position, said operation member having a pushing member extending downwardly therefrom; and an elastic means attached to the lighter body and in sliding contact with said pushing member of said operation member, said elastic means exerting a vertical upward force on said operation member so as to urge said operation member toward said first position, said elastic means connected to said gas lever so as to emit the gas when said operation member moves from said second position to said third position.

2. The lighter as claimed in claim 1, wherein said operation member is mounted on a shaft of said striker wheel.

3. The lighter as claimed in claim 1, wherein said operation member is mounted on a shaft rotatably connected to said lighter body.

4. A light as claimed in claim 1, wherein said operation member has a saftey cover portion covering a flame forming portion including a gas nozzle.

* * * * *